US008439057B2

(12) United States Patent
Parry et al.

(10) Patent No.: US 8,439,057 B2
(45) Date of Patent: May 14, 2013

(54) WALKING STICK

(75) Inventors: Nicholas Parry, Victoria Park (AU); Edward Joseph Khoury, Bateman (AU)

(73) Assignee: Nicholas Parry, Western Australia (AU)

( * ) Notice: Subject to any disclaimer, the term of this patent is extended or adjusted under 35 U.S.C. 154(b) by 0 days.

(21) Appl. No.: 13/400,917

(22) Filed: Feb. 21, 2012

(65) Prior Publication Data

US 2012/0145206 A1 Jun. 14, 2012

Related U.S. Application Data

(63) Continuation of application No. PCT/AU2010/001074, filed on Aug. 20, 2010.

(30) Foreign Application Priority Data

Aug. 21, 2009 (AU) ..... 2009903966

(51) Int. Cl.
*A45B 9/02* (2006.01)

(52) U.S. Cl.
USPC ..... 135/66; 135/69; 135/72; 135/75

(58) Field of Classification Search ..... 135/66, 135/69, 72, 74, 75; 403/109.1, 109.2, 109.3, 403/109.7, 109.8, 377; 248/316.7
See application file for complete search history.

(56) References Cited

U.S. PATENT DOCUMENTS

| | | | | | |
|---|---|---|---|---|---|
| 731,437 | A | * | 6/1903 | Czermark et al. | 248/155.1 |
| 2,495,674 | A | * | 1/1950 | Lewis | 248/410 |
| 2,593,026 | A | | 4/1952 | Hawkins | |
| 3,335,735 | A | * | 8/1967 | Colegrove et al. | 135/69 |
| 4,252,137 | A | * | 2/1981 | Cohen | 135/69 |
| 4,253,479 | A | * | 3/1981 | Laurent | 135/69 |
| 4,300,742 | A | * | 11/1981 | Hunn | 248/689 |
| 4,402,529 | A | * | 9/1983 | Cavazza | 280/816 |

(Continued)

FOREIGN PATENT DOCUMENTS

| | | | |
|---|---|---|---|
| CH | 648460 | A5 | 3/1985 |
| CN | 201210910 | Y | 3/2009 |

OTHER PUBLICATIONS

International Search Report from PCT/AU2010/001074, filed Aug. 20, 2010, mailed Nov. 9, 2010.

*Primary Examiner* — Noah Chandler Hawk
(74) *Attorney, Agent, or Firm* — Patentbar International P.C.

(57) ABSTRACT

A walking stick (10) having a shaft (12) having a first portion (34) and a second portion (36) received within the first portion (34) such that the second portion (36) can slide relative to the first portion (34). A first transverse handle (18) is provided at an upper end of the shaft (12) and a second handle (20) is provided pivotable between a retracted position in which the second handle (20) is generally parallel to the shaft (12) and an extended position in which the second handle (20) extends transversely to the shaft (12). A spring member (48) is provided for biasing the second portion (36) of the shaft (12) to slide outwardly from the first portion (34) and a locking mechanism is provided having a trigger (38) adjacent the first handle (18). The locking mechanism secures the first portion (34) of the shaft (12) relative to the second portion (36) of the shaft (12) and actuation of the trigger (38) releases the locking mechanism such that the second portion (36) of the shaft (12) can slide outwardly from the first portion (34) of the shaft (12) under the force of the spring member (48).

17 Claims, 12 Drawing Sheets

U.S. PATENT DOCUMENTS 4,597,589 A * 7/1986 Fujii et al. ..... 280/821
4,832,304 A * 5/1989 Morgulis ..... 248/533
5,036,873 A * 8/1991 Clayton ..... 135/69
5,056,545 A * 10/1991 Spaeth ..... 135/66
5,456,437 A * 10/1995 Chander et al. ..... 248/316.7
5,771,910 A * 6/1998 Kluttz ..... 135/68
6,109,569 A * 8/2000 Sakaida ..... 248/75
6,409,412 B1 * 6/2002 Huang ..... 403/109.3
6,782,903 B1 * 8/2004 Jarman et al. ..... 135/75
6,869,112 B2 * 3/2005 Guidetti ..... 292/306
7,168,389 B2 * 1/2007 Piedmont ..... 116/174
7,222,892 B2 * 5/2007 Guidetti ..... 292/306
7,650,898 B2 * 1/2010 Jarman et al. ..... 135/75
7,836,904 B1 * 11/2010 Cushman ..... 135/66
2010/0031985 A1 * 2/2010 Decesari ..... 135/66

* cited by examiner 20
18
28
32
44
24
45
B
22
46
48
C
41
40
34
36
70
74
72
D 36
18
32
28
24
44
45
48
46

DETAIL B
SCALE 1 : 2
48
46
43
42
41
40
34

DETAIL C
SCALE 1 : 2
70
74

DETAIL D
SCALE 1 : 2
72

WALKING STICK

RELATED APPLICATIONS

This Application is a Continuation application of International Application PCT/AU2010/001074, filed on Aug. 20, 2010, which in turn claims priority to Australian Patent Applications No. AU 2009903966, filed Aug. 21, 2009, both of which are incorporated herein by reference in their entirety.

FIELD OF THE INVENTION

The present invention relates to a walking stick.

BACKGROUND TO THE INVENTION

Walking sticks commonly comprises a simple shaft having a handle at the upper end. The height of the handle from the ground is generally set at a comfortable level for walking. When the user of the walking stick sits down, the walking stick can be used to assist with returning to a standing position. However, from the sitting position the user will generally need to pull themselves up using the walking stick due to the height of the handle relative to their body.

SUMMARY OF THE INVENTION

The present invention relates to a walking stick having improved features including features aimed at providing assistance for the user when rising from a seated position.

According to one aspect of the present invention there is provided a walking stick comprising:

a shaft having a first portion and a second portion received within the first portion such that the second portion can slide relative to the first portion;

a first transverse handle at an upper end thereof;

a second handle adjacent the upper end thereof pivotable between a retracted position in which the second handle is generally parallel to the shaft and an extended position in which the second handle extends transversely to the shaft;

a spring member biasing the second portion of the shaft to slide outwardly from the first portion; and a locking mechanism having a trigger adjacent the first handle;

wherein the locking mechanism secures the first portion of the shaft relative to the second portion of the shaft and actuation of the trigger releases the locking mechanism such that the second portion of the shaft can slide outwardly from the first portion of the shaft under the force of the spring member.

Preferably the first and second handles are provided on a handle unit comprising a handle body secured to the upper end of the shaft and the first handle extends transversely from a distal end of the handle body.

Preferably the handle body is provided with a recess that receives the second handle when in the retracted position such that the second handle is contained within the recess.

In a preferred embodiment, the second handle extends generally horizontally away from the upper end of the handle body in the extended position and is generally collinear to the first handle.

Preferably the trigger is located below the first handle such that the trigger can be depressed while holding the first handle.

In one embodiment, the locking mechanism comprises:

a rod extending upwardly from an inner end of the second portion of the shaft such that the spring member engages between an upper end of the rod and the first portion of the shaft; and an engagement member provided within the first portion of the shaft that engages with the rod;

wherein actuation of the trigger acts on the engagement member to release the shaft such that the second portion of the shaft is free to move relative to the first portion of the shaft.

The spring member is preferably provided in a tube located in the first portion of the shaft above the engagement member and an upper end of the rod is received in the tube.

Preferably the engagement member comprises a pair of flexible arms joined at first ends thereof and the rod passes through apertures in the flexible arms such that when the flexible arms are flexed towards each other under action of a force, the apertures align to allow the rod to slide through the apertures.

In a preferred embodiment, the trigger comprises a first portion extending outwardly from the handle body below the first handle and a second portion extending downwardly inside the handle body to engage with an elongate member within the first portion of the shaft such that pulling upwardly on the trigger causes the second portion to move the elongate member downwardly to act on the flexible arms of the engagement and to move them towards each other.

The second handle preferably includes a latch mechanism provided to secure the second handle in the extended position.

In one embodiment, the latch mechanism comprises an arm member pivotally connected at a first end thereof within the recess having lugs provided on a second end thereof and slots provided in the second handle having notches into which the lugs are pulled by a tension spring when the second handle moves to the extended position such that while the lugs are located in the notches, the second handle is prevented from moving back to the retracted position.

The shaft may be provided with a third portion sized to be slidably received in the second portion. Preferably a locking ring is provided adjacent the lower end of the second portion of the shaft to lock the third portion relative to the second portion.

A foot is preferably provided at the lower end of the third portion of the shaft to engage with the ground. Preferably the foot is provided with an upper portion connected to the shaft and a lower portion connected to the upper portion by a spring to provide cushioning when the foot is placed on the ground during use.

One or more attachment units may be provided each including one or more semi-circular clips to be received around the first portion of the shaft.

Preferably the first portion of the shaft is provided with a pair of longitudinal grooves on opposite sides thereof and each clip is flexible and includes a pair of lugs such that pushing the clip onto the first portion of the shaft spreads the clip apart until the lugs are received in the grooves.

Each clip preferably includes a rib on a first end and a transverse groove on a second opposite end thereof such that the rib of a clip can be received in the transverse groove of an adjacent clip such that clips of adjacent attachment units may be connected together. The attachment units may comprise a light or a storage container

BRIEF DESCRIPTION OF THE DRAWINGS

The invention will now be described, by way of example, with reference to the following drawings in which.

DETAILED DESCRIPTION OF PREFERRED EMBODIMENTS

Figure 1A:
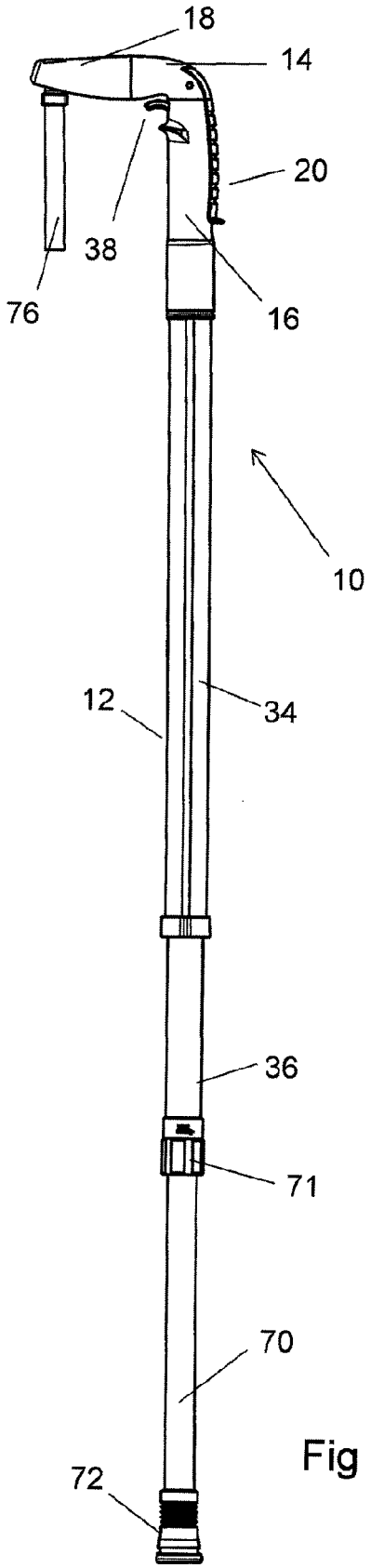
FIG. 1*a* is front view of a walking stick in accordance with the present invention in an extended configuration.

Referring to the Figures, there is shown a walking stick 10 comprising a shaft 12 having a handle unit 14 at an upper end thereof. The handle unit 14 comprises a handle body 16 secured to the upper end of the shaft 12. The handle body 16 includes a first handle 18 extending transversely from a distal end of the handle body 16. The first handle 18 in this embodiment is formed integrally with the handle body 16 and functions as a standard walking stick handle providing a generally horizontal surface on which the user can lean to support their weight.

Figure 1B:
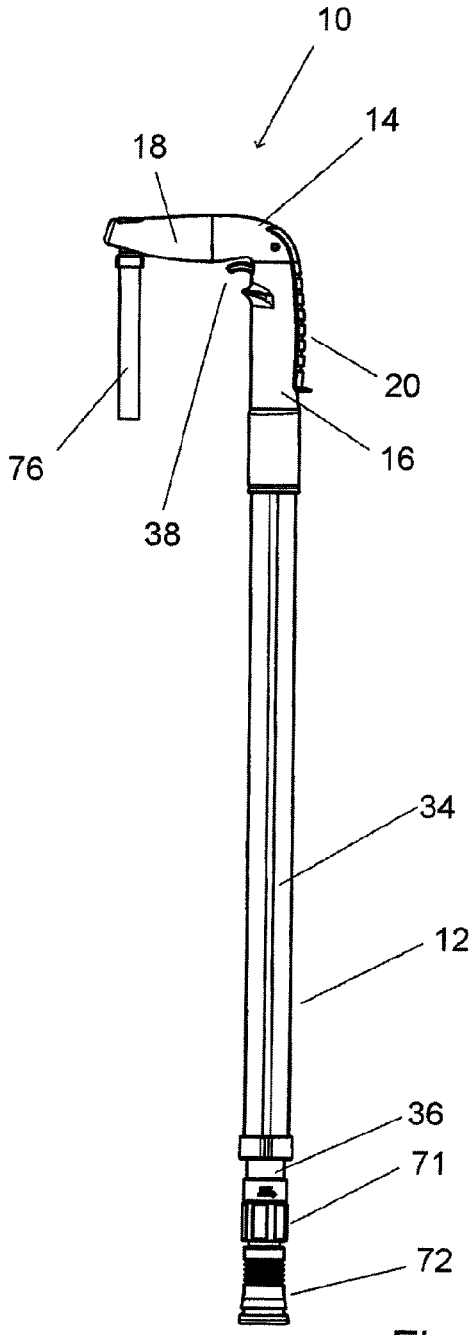
FIG. 1*b* is a front view of the walking stick of FIG. 1*a* in a collapsed configuration.
Figure 2A:
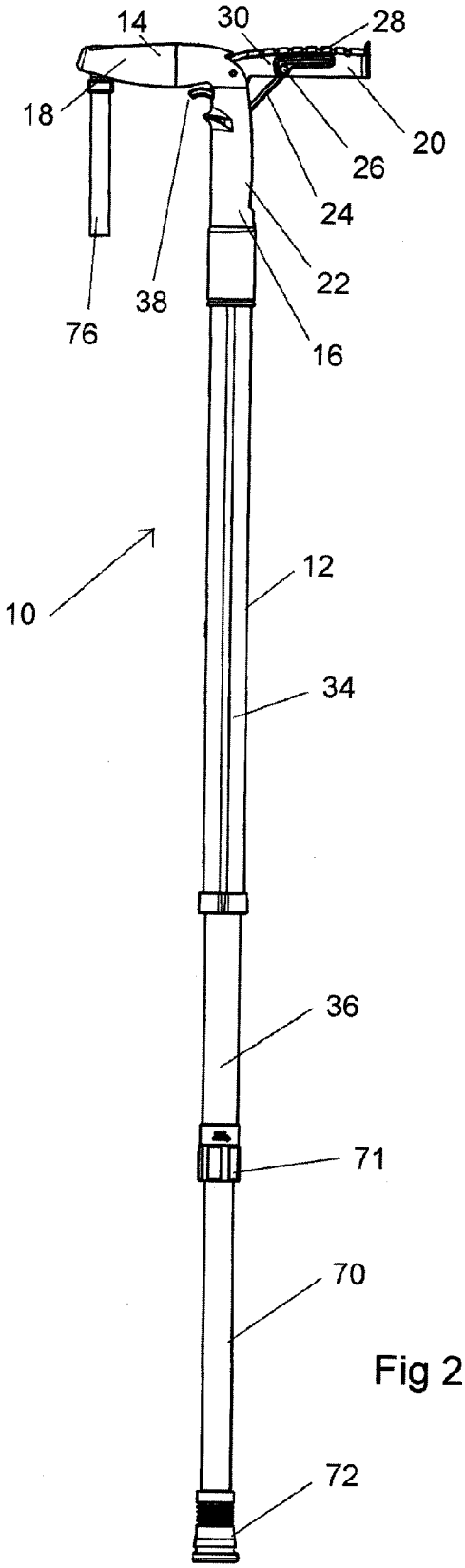
FIG. 2*a* is a front view of the walking stick of FIG. 1 in an extended configuration with the second handle extended.
Figure 2B:
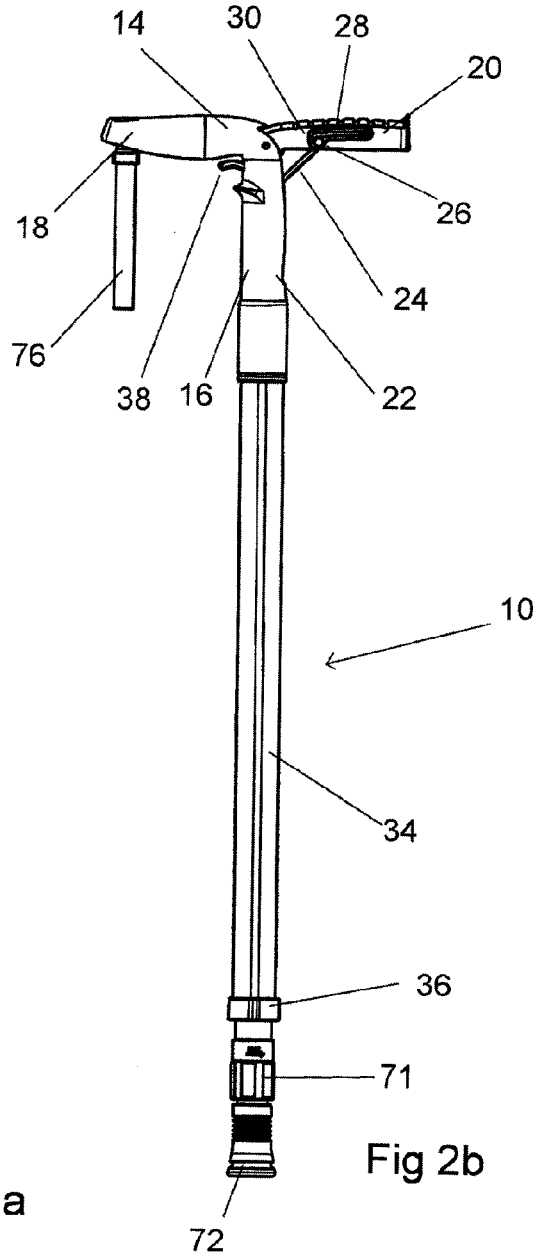
FIG. 2*b* is a front view of the walking stick of FIG. 1 in a collapsed configuration with the second handle extended.
Figure 3A:
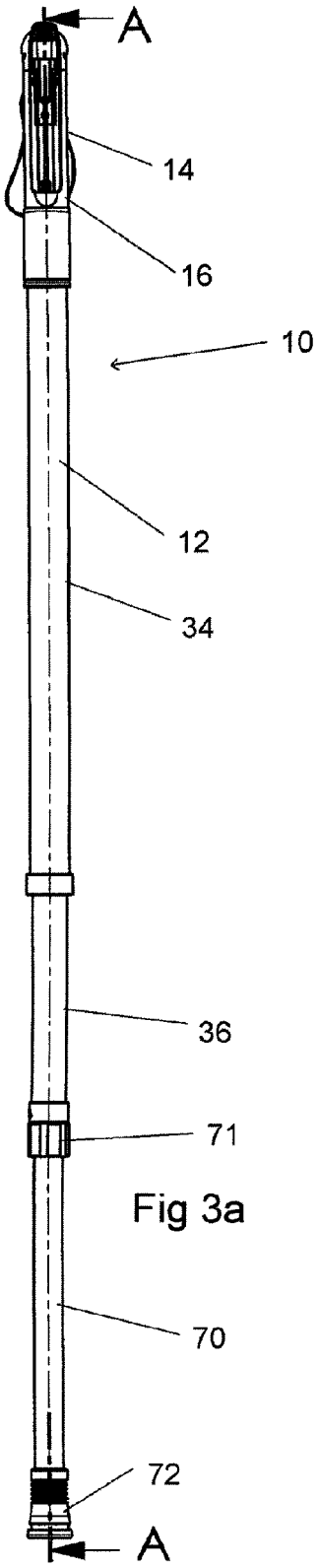
FIG. 3*a* is a side view of the walking stick of FIG. 1 in an extended configuration with the second handle extended.
Figure 3B:
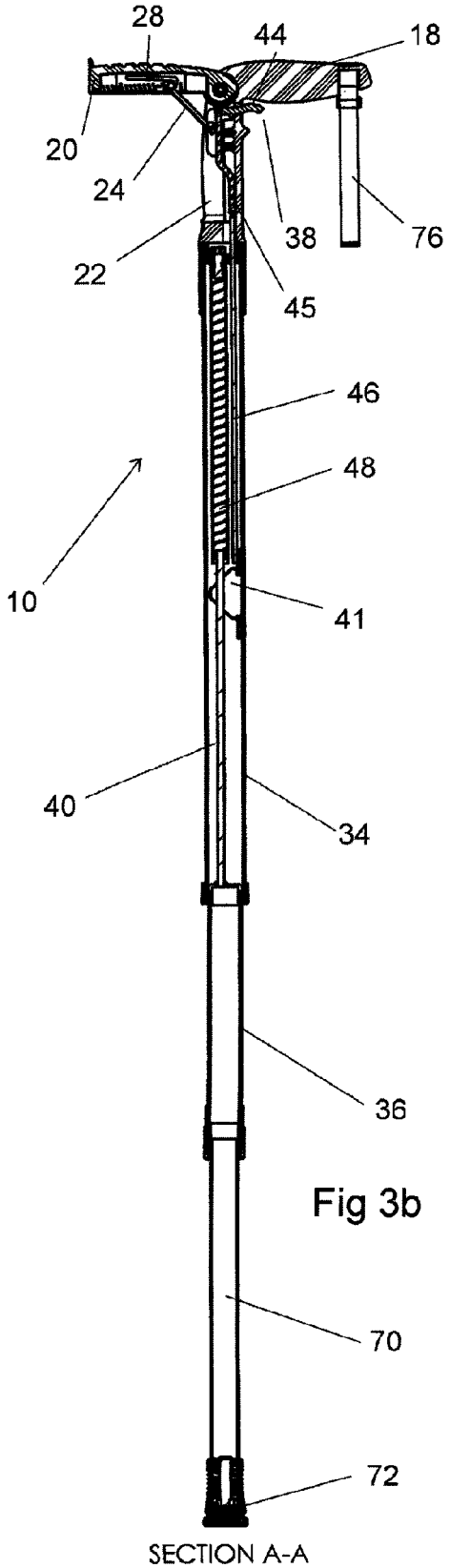
FIG. 3*b* is a back cross sectional view of the walking stick of FIG. 1 in an extended configuration with the second handle extended.
Figure 4:
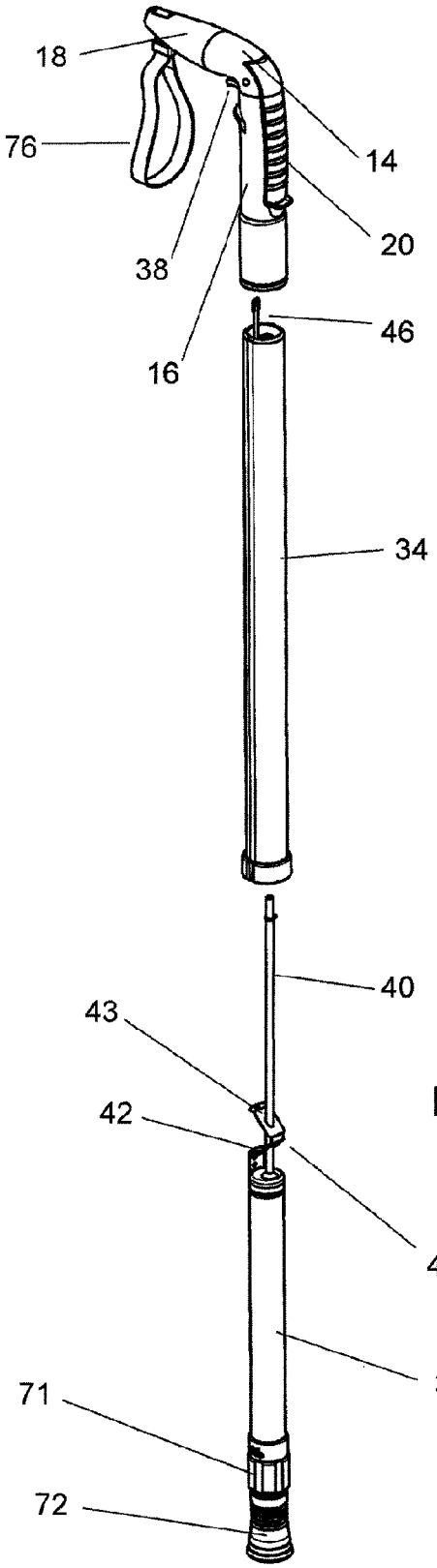
FIG. 4 is an exploded view of the walking stick of FIG. 1.
Figure 5:
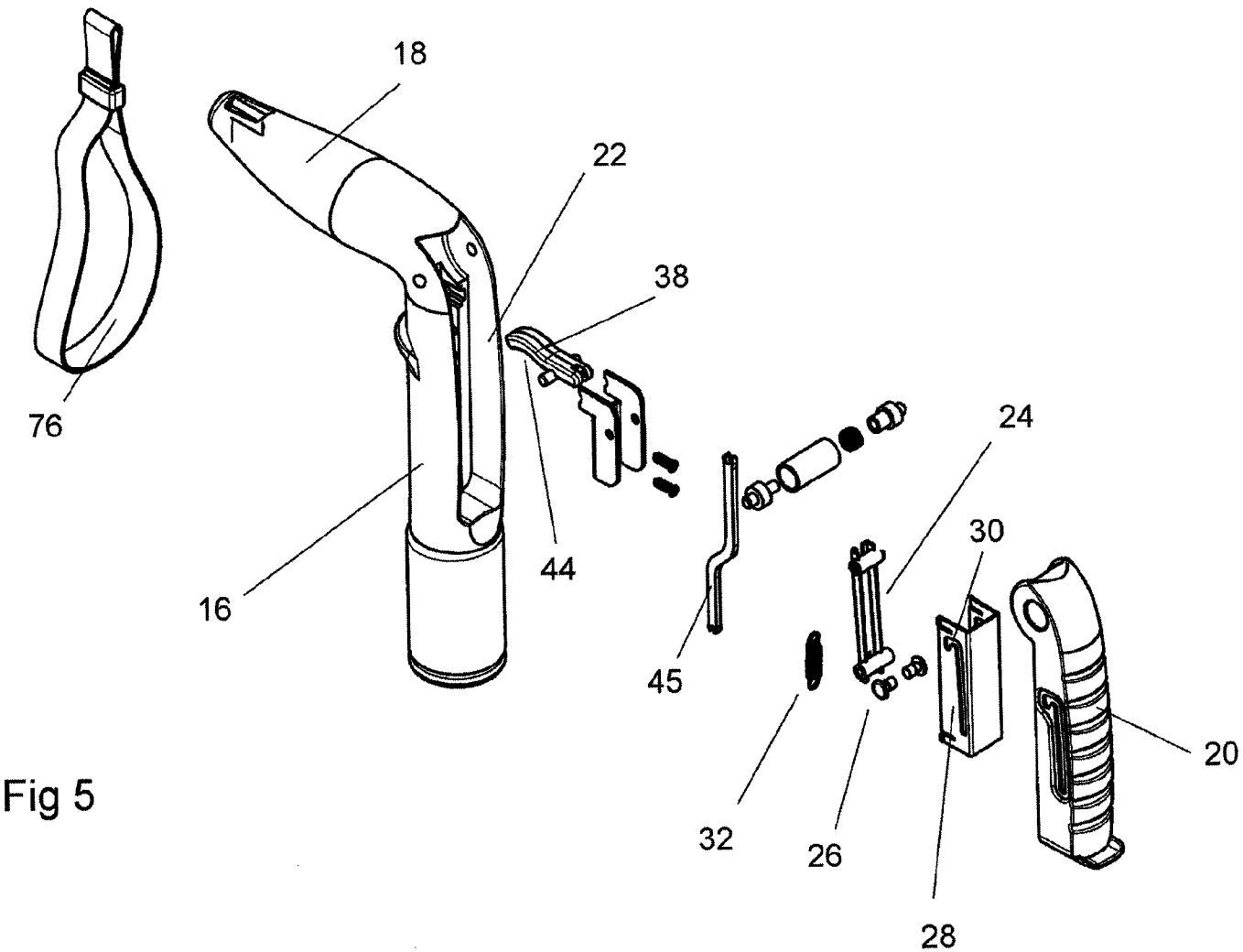
FIG. 5 is an exploded view of the handle unit of the walking stick of FIG. 1.
Figure 6:
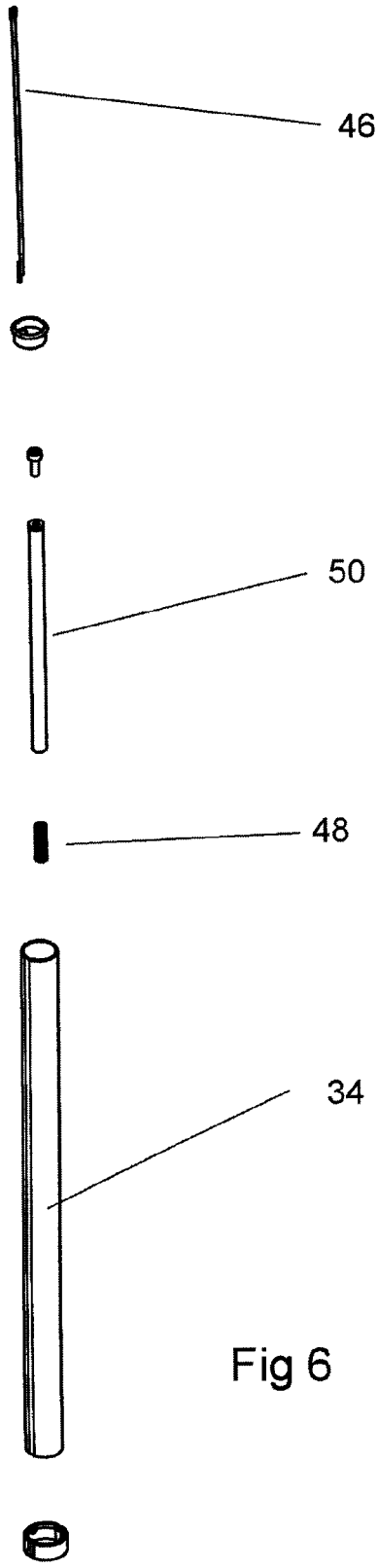
FIG. 6 is an exploded view of the first portion of the shaft of the walking stick of FIG. 1.
Figure 7A:
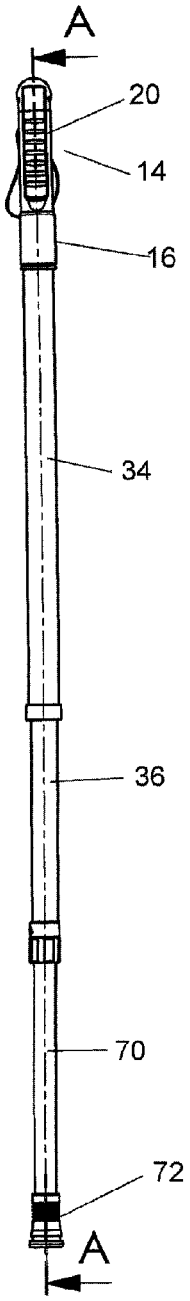
FIG. 7*a* is a side view of the walking stick of FIG. 1 in an extended configuration with the second handle retracted.
Figure 7B:
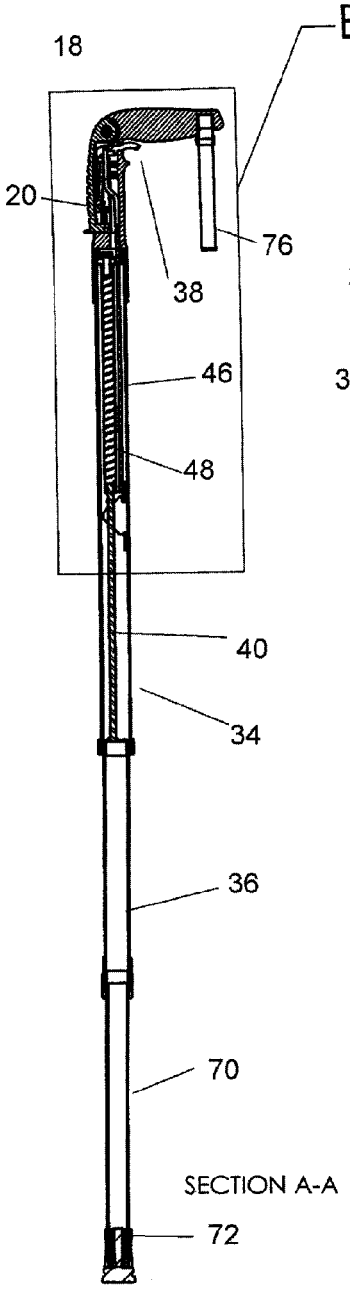
FIG. 7*b* is a back cross sectional view of the walking stick of FIG. 1 in an extended configuration with the second handle retracted.
Figure 7C:
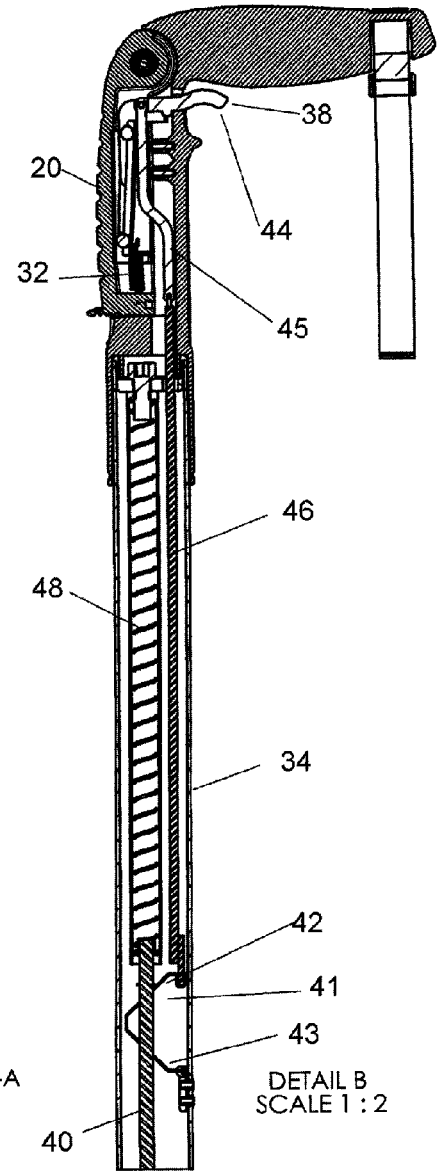
FIG. 7*c* is a close up of Detail B of FIG. 7*b;*
Figures 8A, 8B, 8C:
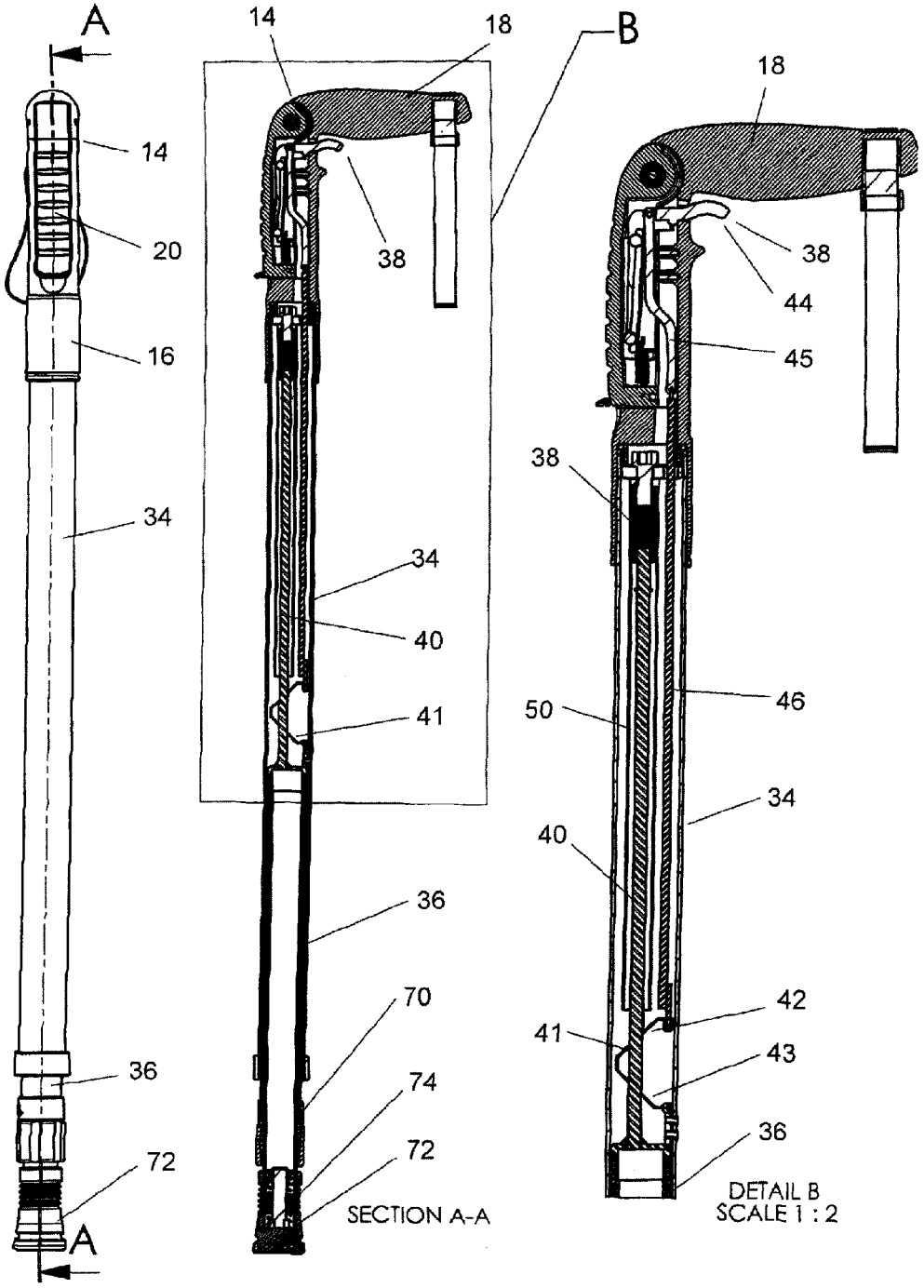
FIG. 8*a* is a side view of the walking stick of FIG. 1 in a collapsed configuration with the second handle retracted.
FIG. 8*b* is a back cross sectional view of the walking stick of FIG. 1 in a collapsed configuration with the second handle retracted.
FIG. 8*c* is a close up of Detail B of FIG. 8*b;*
Figures 9A, 9B, 9C, 9D:
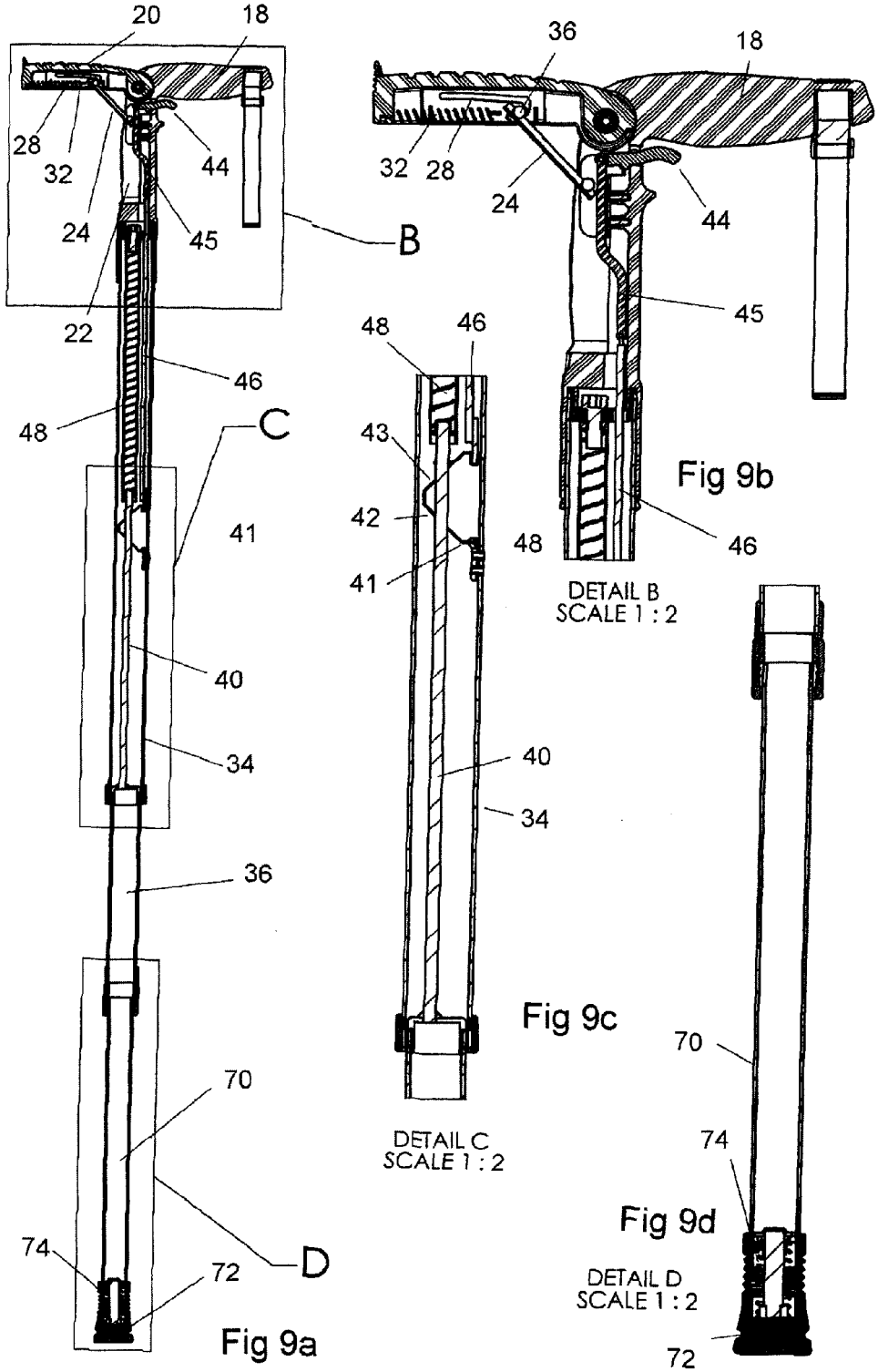
FIG. 9*a* is a back cross sectional view of the walking stick of FIG. 1 in an extended configuration with the second handle extended.
FIG. 9*b* is a close up of Detail B of FIG. 9*a;*
FIG. 9*c* is a close up of Detail C of FIG. 9*a;*
FIG. 9*d* is a close up of Detail D of FIG. 9*a;*
Figure 10A:
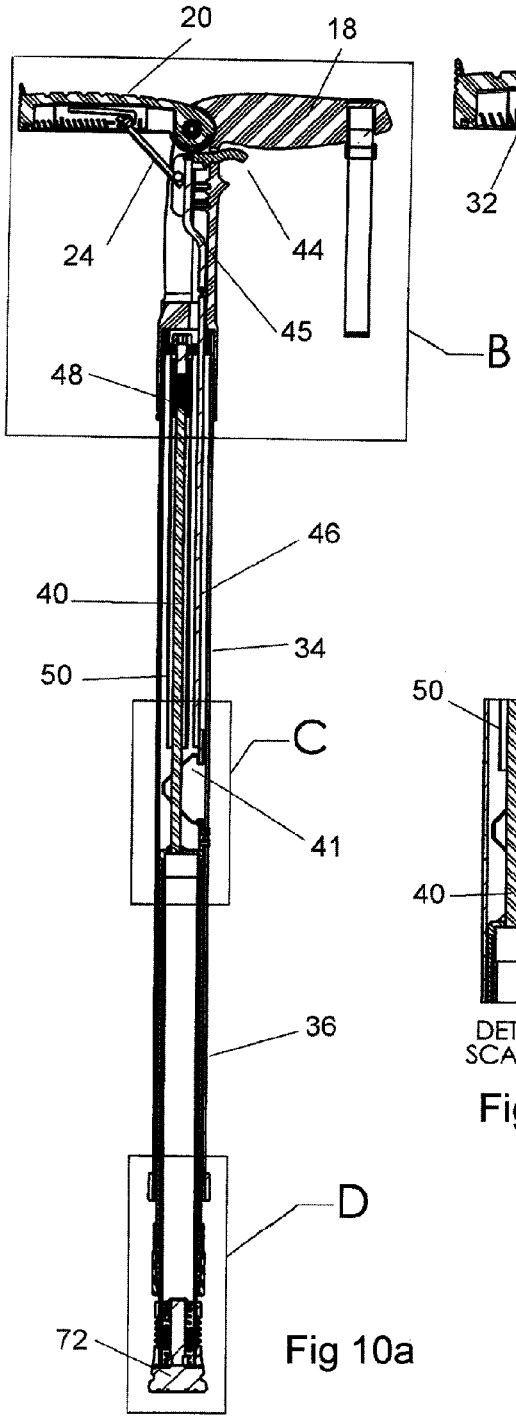
FIG. 10*a* is a back cross sectional view of the walking stick of FIG. 1 in a collapsed configuration with the second handle extended.
Figure 10B:
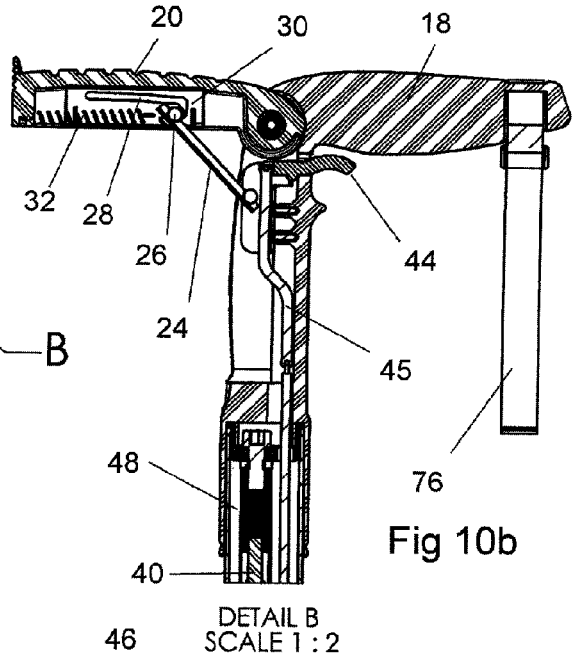
FIG. 10*b* is a close up of Detail B of FIG. 10*a;*
Figure 10C:
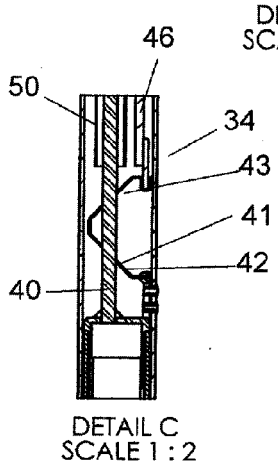
FIG. 10*c* is a close up of Detail C of FIG. 10*a;*
Figure 10D:
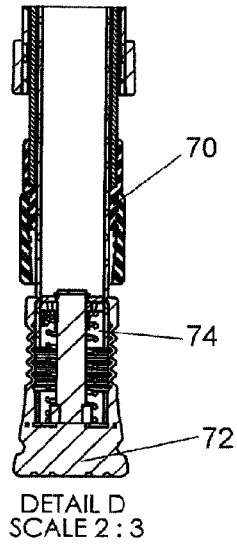
FIG. 10*d* is a close up of Detail D of FIG. 10*a;*
Figure 11A:
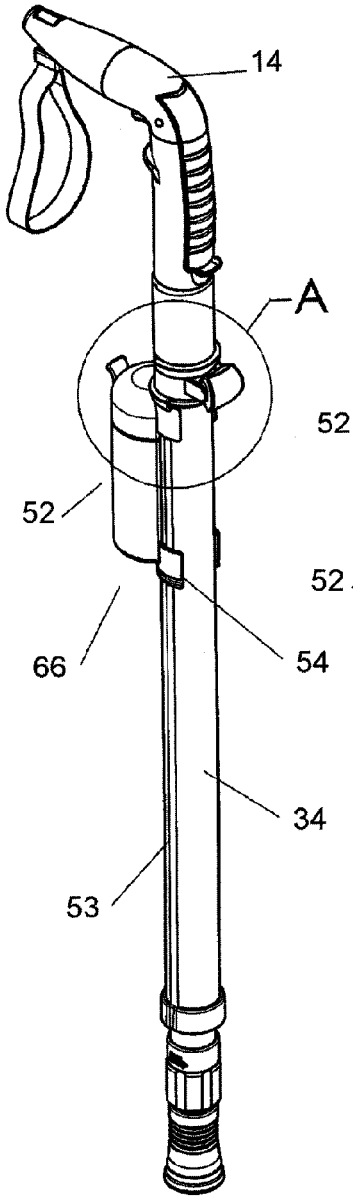
FIG. 11*a* is a perspective view of the walking stick of FIG. 1 showing a plurality of attachment units connected to the shaft.
Figure 11B:
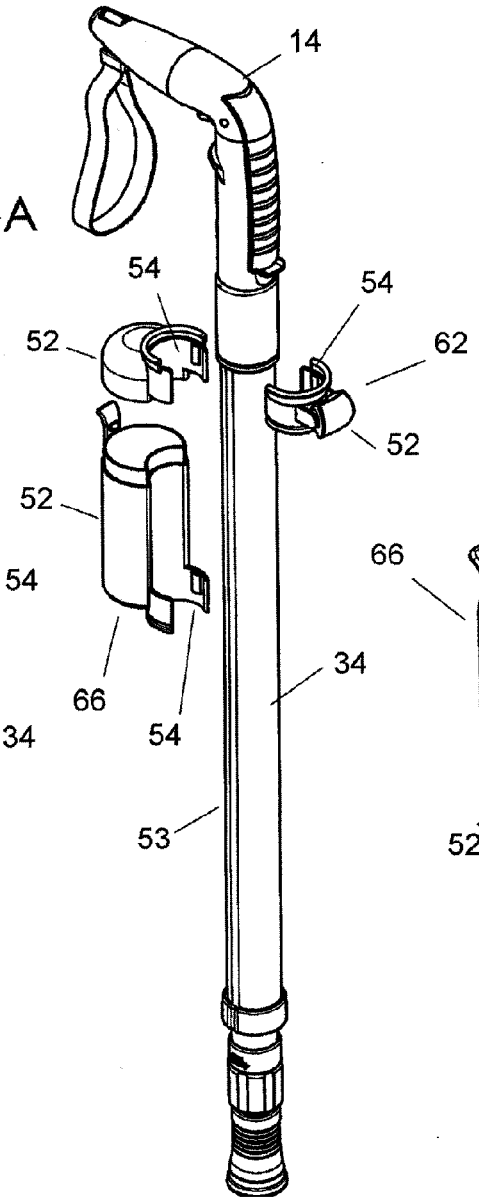
FIG. 11*b* is a perspective view of the walking stick of FIG. 1 showing the attachment units disconnected from the shaft.
Figure 11C:
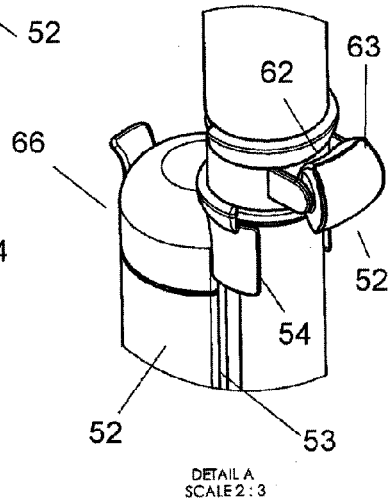
FIG. 11*c* is a close up of Detail A of FIG. 11*a*.
Figure 11D:
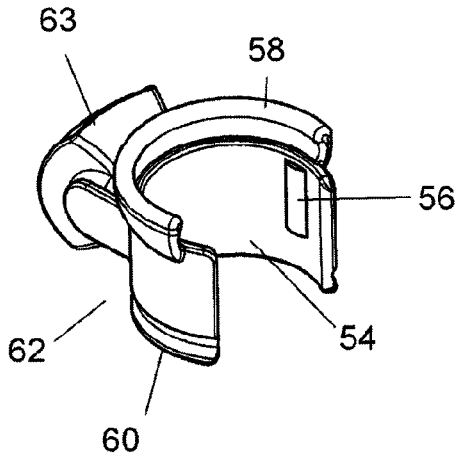
FIGS. 11*d* and 11*e* are perspective views of different embodiments of the attachment units.
Figure 11E:
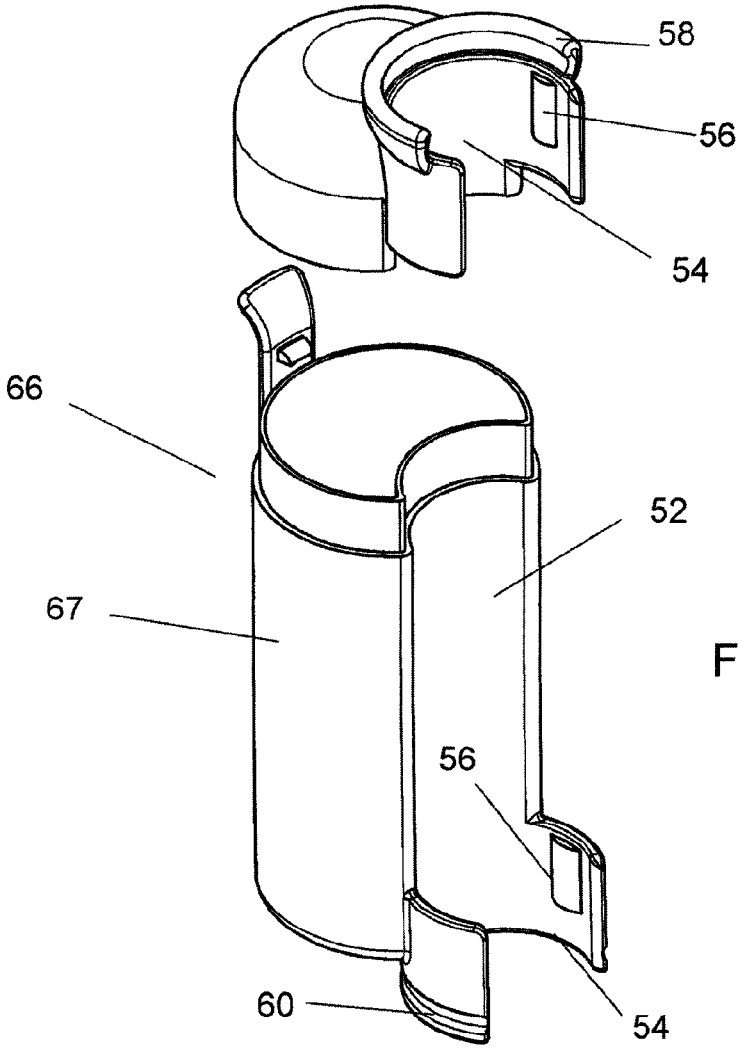

The handle unit 14 is provided also with a second handle 20 that is pivotally connected to the handle body 16. The second handle 20 is pivotally connected at a first end thereof adjacent an upper end of the handle body 16. The second handle 20 is pivotable between a retracted position (as shown in FIG. 1 and an extended position (as shown in FIG. 2). In the retracted position, the second handle 20 extends generally downwardly from the first end thereof parallel to the handle body 16 and the shaft 12. The handle body 16 is provided with a recess 22 that receives the second handle 20 when in the retracted position such that the second handle 20 is contained within the recess 22.

In the extended position, the second handle 20 extends generally horizontally away from the upper end of the handle body 16. The second handle 20 in the extended position is generally collinear with the first handle 18. Upper surfaces of the first and second handles 18 and 20 thereby provide an extended surface on which the user can lean with both hands, each hand resting on one the handles 18 and 20.

The second handle 20 includes a latch mechanism provided to secure the second handle 20 in the extended position. The latch mechanism includes an arm member 24 pivotally connected at a first end thereof within the recess 22. A second end of the arm member 24 includes lugs 26 received in slots 28 in the second handle 20. The slots 28 are provided in opposite side walls of the second handle 20 and are oriented generally parallel to the second handle 20. The lugs 26 are provided on opposed sides of the arm member 24 such that each lug 26 is received in an adjacent slot 28.

When the second handle 20 is moved to the extended position, the lugs 26 slide from first ends of the slots 28 to second ends of the slots 28. The second ends of the slot 28 are provided with curved notches 30 into which the lugs 26 are pulled by a tension spring 32 connected to the arm member 24. While the lugs 26 are located in the notches 30, the second handle 20 is prevented from moving back to the retracted position. The arm member 24 can be pushed against the force of the tension spring 32 such that the lugs 26 move out of the notches 30 when it is desired to move the second handle 20 back to the retracted position.

The shaft 12 comprises a first portion 34 and a second portion 36. The shaft 12 is generally cylindrical and the second portion 36 is slidably received in a lower end of the first portion 34. The upper end of the first portion 34 is secured to the handle body 16. The second portion 36 of the shaft 12 can thereby slide in and out of the first portion 34 to either increase or decrease the total length of the shaft 12.

The walking stick 10 includes a spring member 48 to bias the second portion 36 such that it tends to move outwardly of the first portion 34 and a locking mechanism to secure the second portion 36 relative to the first portion 34. The locking mechanism can be released by a trigger 38 provided on the handle body 16 in order to allow the second portion 36 to slide outwardly relative to the first portion 34 under the force of the spring member 48. The trigger 38 is located below the first handle 18 such that the trigger can be depressed while holding the first handle 18.

In the embodiment shown, the locking mechanism includes a rod 40 extending from an inner end of the second portion 36 of the shaft 12 into the first portion 34 of the shaft. Also provided is an engagement member 41 provided within the first portion 34 of the shaft 12 that engages with the rod 40. The engagement member 41 is secured relative to the first portion 34 of the shaft and comprises a pair of flexible arms 42 and 43 joined at first ends thereof. Second ends of the flexible arms 42 and 43 extend outwardly and away from each other. Each of the flexible arms 42 and 43 includes an aperture through which the rod 40 passes. The apertures in the flexible arms 42 and 43 are arranged such that when the flexible arms 42 and 43 are flexed towards each other under action of a force, the apertures align to allow the rod 40 to slide through the apertures. When the force is released, the flexible arms 42 and 43 move apart and edges of the apertures engage with the rod 40 to prevent the rod 40 sliding through.

The trigger 38 comprises a first portion 44 extending outwardly from the handle body 16 below the first handle 18 and a second portion 45 extending downwardly inside the handle body 16. The first portion 44 is pivotally mounted such that pulling upwardly on the first portion 44 of the trigger 38 causes the second portion 45 to move downwardly inside the handle body 16. The lower end of the second portion 45 engages with an elongate member 46 that is provided within the first portion 34 of the shaft 12 extending from the second portion 45 of the trigger 38 to the engagement member 41. When the second portion 45 of the trigger 38 moves downwardly, it pushes the elongate member 46 downwardly, which acts on the flexible arms 42 and 43 to move them towards each other. That is, pulling on the trigger 38 releases the rod 40 and allows the second portion 36 of the shaft to slide relative to the first portion 35.

The spring member 48 is provided in a tube 50 located in the first portion 34 of the shaft 12 above the engagement member 41 such that an upper end of the rod 40 is received in the tube 50. The spring member 48 acts between an upper end of the tube 50 and the upper end of the rod 40 to provide a force on the second portion 36 of the shaft to move it outwardly from the first portion 34. Therefore, when the trigger 38 is actuated, the second portion 36 of the shaft 12 can move outwardly from the first portion 34, thereby increasing the total length of the shaft 12. Also, if the second portion 36 of the shaft 12 is resting on the ground and a force is applied by the user downwardly on the handle unit 14, the second portion 36 of the shaft 12 can be pushed inwardly into the first portion 34 against the force of the spring member 48 to reduce the total length of the shaft 12 of the walking stick 10.

The shaft 12 may also be provided with a third portion 70 sized to be slidably received in the second portion 36. The third portion 70 may be slid out of the second portion 36 to provide for further adjustment of the total length of the walking stick 10 in use. A locking ring 71 is provided adjacent the lower end of the second portion 36 of the shaft to lock the third portion 70 in the correct position relative to the second portion 36.

Further, a foot 72 is provided at the lower end of the third portion 70 of the shaft 12 to engage with the ground. The foot 72 is provided with an upper portion connected to the shaft 12 and a lower portion connected to the upper portion by a spring 74. The spring 74 provides for some cushioning when the foot is placed on the ground during use.

The walking stick 10 is also provided with one or more attachment units 52. The first portion 34 of the shaft 12 is provided with a pair of longitudinal grooves 53 on opposite sides thereof. Each attachment unit 52 includes one or more semi-circular clips 54 to be received around the first portion 36 of the shaft 12. Each clip 54 is flexible and includes a pair of lugs 56 such that pushing the clip 54 onto the first portion 34 of the shaft 12 spreads the clip 54 apart until the lugs 56 are received in the grooves 53, thereby engaging the clip 54 with the shaft 12. Also, each clip 54 includes a rib 58 on a first end and a transverse groove 60 on a second opposite end thereof. In use, the rib 58 of a clip 54 can be received in the transverse groove 60 of an adjacent clip 54 such that clips 54 of adjacent attachment units 52 may be connected together.

Each attachment unit 52 is provided with a device that may be required for use by the user of the walking stick 10. In the embodiment shown, a first attachment unit 62 is each provided having a light 63. The light 63 provides a visual indication of presence of the user of the walking stick in conditions of low light. A second attachment unit 66 is provided with a storage container 67 having a lid for storing small personal items. The third attachment unit 66 is provided with a pair of clips 54 at upper and lower ends thereof.

In use, the user of the walking stick 10 can use it in a standard manner for walking with the second handle 20 retracted and the second portion 36 of the shaft 12 secured relative to the first portion 34. When the user is seated and needs to get up, the second handle 20 can be pulled out and locked in the extended position. The trigger 38 is pulled and the user presses down on the handle unit 14 to push the second portion 36 of the shaft 12 into the first portion 34, thereby lowering the height of the handle unit 14. The user can then lean downwardly on both the first and second handles 18 and 20 to aid in pushing them to a standing position. As the person rises to a standing position, the trigger 38 can again be depressed and while the force applied downwardly on the handle unit 14 is less than that supplied by the spring member 48, the second portion 36 extends from the first portion 34, increasing the length of the shaft 12 to that required for normal use in the standing position.

It will be readily apparent to persons skilled in the relevant arts that various modifications and improvements may be made to the foregoing embodiments, in addition to those already described, without departing from the basic inventive concepts of the present invention.

What is claimed is:

1. A walking stick comprising:

a shaft having a first portion and a second portion received within the first portion such that the second portion can slide relative to the first portion;

a handle unit comprising a handle body secured to the upper end of the shaft;

a first handle extending transversely from a distal end of the handle body;

a second handle adjacent the distal end of the handle body pivotable between a retracted position in which the second handle is generally parallel to the shaft and contained entirely within a recess in the handle body, and an extended position in which the second handle extends transversely to the shaft;

a spring member biasing the second portion of the shaft to slide outwardly from the first portion; and a locking mechanism having a trigger adjacent the first handle;

wherein the locking mechanism secures the first portion of the shaft relative to the second portion of the shaft and actuation of the trigger releases the locking mechanism such that the second portion of the shaft can slide outwardly from the first portion of the shaft under the force of the spring member.

2. A walking stick in accordance with claim 1, wherein the second handle extends generally horizontally away from the upper end of the handle body in the extended position and is generally collinear to the first handle.

3. A walking stick in accordance with claim 1, wherein the trigger is located below the first handle such that the trigger can be depressed while holding the first handle.

4. A walking stick in accordance with claim 1, wherein the locking mechanism comprises:

a rod extending upwardly from an inner end of the second portion of the shaft such that the spring member engages between an upper end of the rod and the first portion of the shaft; and an engagement member provided within the first portion of the shaft that engages with the rod;

wherein actuation of the trigger acts on the engagement member to release the shaft such that the second portion of the shaft is free to move relative to the first portion of the shaft.

5. A walking stick in accordance with claim 4, wherein the spring member is provided in a tube located in the first portion of the shaft above the engagement member and an upper end of the rod is received in the tube.

6. A walking stick in accordance with claim 5, wherein the engagement member comprises a pair of flexible arms joined at first ends thereof and the rod passes through apertures in the flexible arms such that when the flexible arms are flexed towards each other under action of a force, the apertures align to allow the rod to slide through the apertures.

7. A walking stick in accordance with claim 6, wherein the trigger comprises a first portion extending outwardly from the handle body below the first handle and a second portion extending downwardly inside the handle body to engage with an elongate member within the first portion of the shaft such that pulling upwardly on the trigger causes the second portion to move the elongate member downwardly to act on the flexible arms of the engagement and to move them towards each other.

8. A walking stick in accordance with claim 1, wherein the second handle includes a latch mechanism provided to secure the second handle in the extended position.

9. A walking stick in accordance with claim 8, wherein the latch mechanism comprises an arm member pivotally connected at a first end thereof within the recess having lugs provided on a second end thereof and slots provided in the second handle having notches into which the lugs are pulled by a tension spring when the second handle moves to the extended position such that while the lugs are located in the notches, the second handle is prevented from moving back to the retracted position.

10. A walking stick in accordance with claim 1, wherein the shaft is provided with a third portion sized to be slidably received in the second portion.

11. A walking stick in accordance with claim 10, wherein a locking ring is provided adjacent the lower end of the second portion of the shaft to lock the third portion relative to the second portion.

12. A walking stick in accordance with claim 1, wherein a foot is provided at the lower end of the third portion of the shaft to engage with the ground.

13. A walking stick in accordance with claim 12, wherein the foot is provided with an upper portion connected to the shaft and a lower portion connected to the upper portion by a spring to provide cushioning when the foot is placed on the ground during use.

14. A walking stick in accordance with claim 12, wherein one or more attachment units are provided each including one or more semi-circular clips to be received around the first portion of the shaft.

15. A walking stick in accordance with claim 14, wherein the first portion of the shaft is provided with a pair of longitudinal grooves on opposite sides thereof and each clip is flexible and includes a pair of lugs such that pushing the clip onto the first portion of the shaft spreads the clip apart until the lugs are received in the grooves.

16. A walking stick in accordance with claim 15, wherein each clip includes a rib on a first end and a transverse groove on a second opposite end thereof such that the rib of a clip can be received in the transverse groove of an adjacent clip such that clips of adjacent attachment units may be connected together.

17. A walking stick in accordance with claim 14, wherein the attachment units comprise a light or a storage container.

* * * * *